US006120389A

United States Patent [19]

Kruse

[11] Patent Number: 6,120,389

[45] Date of Patent: Sep. 19, 2000

[54] GOLF CLUB HEAD

[75] Inventor: Steinar Kruse, Lillestrom, Norway

[73] Assignee: Millennium Golf AS, Holmestrand, Norway

[21] Appl. No.: 09/281,415

[22] Filed: Mar. 30, 1999

[30] Foreign Application Priority Data

Jan. 29, 1999 [NO] Norway ..... 990431

[51] Int. Cl.[7] ..... A63B 53/04

[52] U.S. Cl. ..... 473/328

[58] Field of Search ..... 473/324, 327, 473/328, 349, 350, 345, 228, 290, 291, 344, 346; D21/733

[56] References Cited

U.S. PATENT DOCUMENTS 2,550,846 5/1951 Milligan .
5,456,469 10/1995 MacDougall .
5,465,970 11/1995 Adams et al. .
5,524,890 6/1996 Kim et al. .
5,785,609 7/1998 Sheets .

FOREIGN PATENT DOCUMENTS 0542407 5/1993 European Pat. Off. .
340579 1/1931 United Kingdom .

*Primary Examiner*—Sebastiano Passaniti
*Attorney, Agent, or Firm*—Ladas & Parry

[57] ABSTRACT

Golf club head (1) of the wood type with a striking surface (2) on the front area, a shaft connection (3) on one of the sides (4) in relation to the striking surface (2) and with a bottom surface (5) that normally exhibits slanted areas towards both side edges (4*a*) as well as towards the back edge (10*a*) from a central area (6). The bottom surface (5) from the central area (6) to the bottom area's front edge (7) towards the striking surface (2) is shaped with a curved lowered area (8) in relation to the adjoining underside areas (9) on both sides. The lowered area (8) increases evenly in depth towards the front edge (7).

8 Claims, 12 Drawing Sheets

GOLF CLUB HEAD

BACKGROUND OF THE INVENTION

This invention is concerned with a golf club head of the wood type, with a striking surface on the face, a shaft connection on one of the sides in relation to the striking surface and with a bottom surface which normally exhibits slanting areas towards both the side edges and the back edge from a central area.

There are today many golf clubs, or to be more precise, golf club heads of the type mentioned above. These club heads have a bottom surface or sole shape that results in relatively large areas being exposed to the ground during the strike. This will obviously result in great friction resistance between the club's sole and the ground, which again results in part of the force of the strike being lost in the form of friction against the ground.

One aim of the present invention is therefore to eliminate or at least reduce this loss in friction as much as possible, so that as much force as possible is transferred to the golf ball, thus increasing the length of the strike correspondingly.

Some golf club manufacturers have taken this into consideration and have reduced the surface that crosses the ground, in an attempt to avoid this. Other manufacturers have also lifted the sole slightly just behind the face of the club head to obtain the same effect, i.e. minimal contact with the ground during the strike. Most of the golf clubs in existence today are designed so that the face is the lowest point on the club head during the strike. This can often result in a less experienced golfer striking low and often taking some earth/grass with the ball, which results in the very power of the strike against the ball being small which in turn means that the desired length of the strike is not obtained. A major part of the drive in other words goes towards digging the club head into the ground. To overcome this, some golf club manufacturers have made some groove like ribs in the sole, slightly behind the club head's face. The disadvantage with such solutions however, is that one will not always acquire a defined distance between the clubs lower end and the ground surface underneath.

SUMMARY OF THE INVENTION

The aim of the present invention is therefore to solve the problems described above.

This is achieved according to the invention by the bottom surface from the central part to the front edge of the bottom surface toward the striking surface being designed with a curved lowered part in relation to the adjoining underside areas on both sides, the lowered part of which increases evenly in depth towards the front edge.

BRIEF DESCRIPTION OF THE DRAWING

The embodiments of the golf club head according to the present invention will now be explained with reference to figures, where.

DESCRIPTION OF EMBODIMENTS

Figure 1:
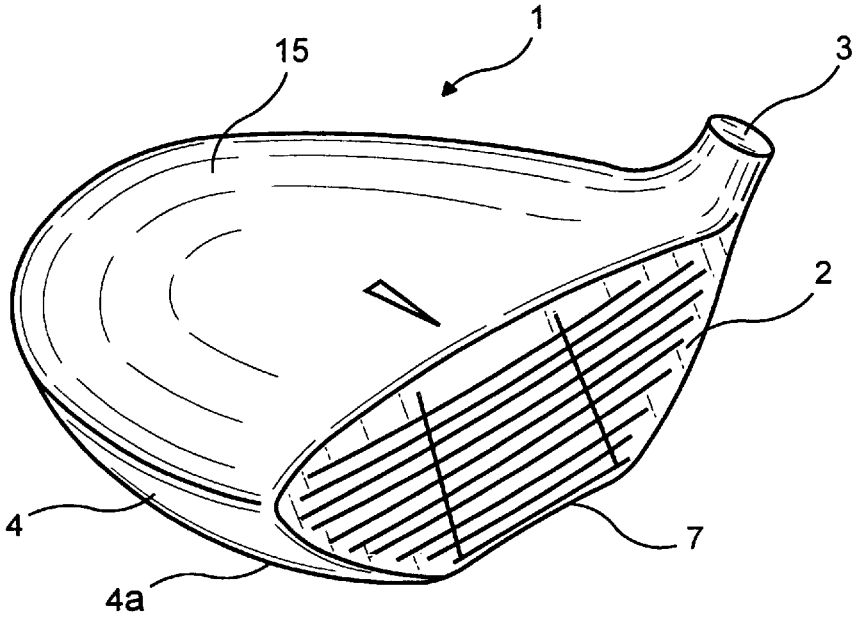
FIG. 1 shows a golf club head according to the present invention seen from above with the striking surface pointing to the right.
Figure 2:
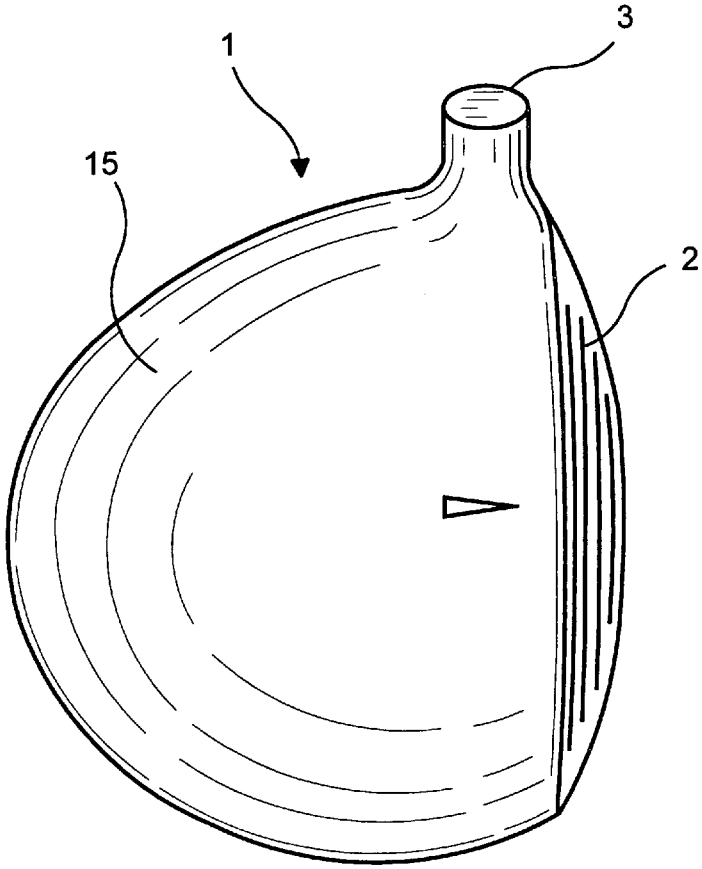
FIG. 2 shows the golf club head according to FIG. 1, seen from above.
Figure 3:
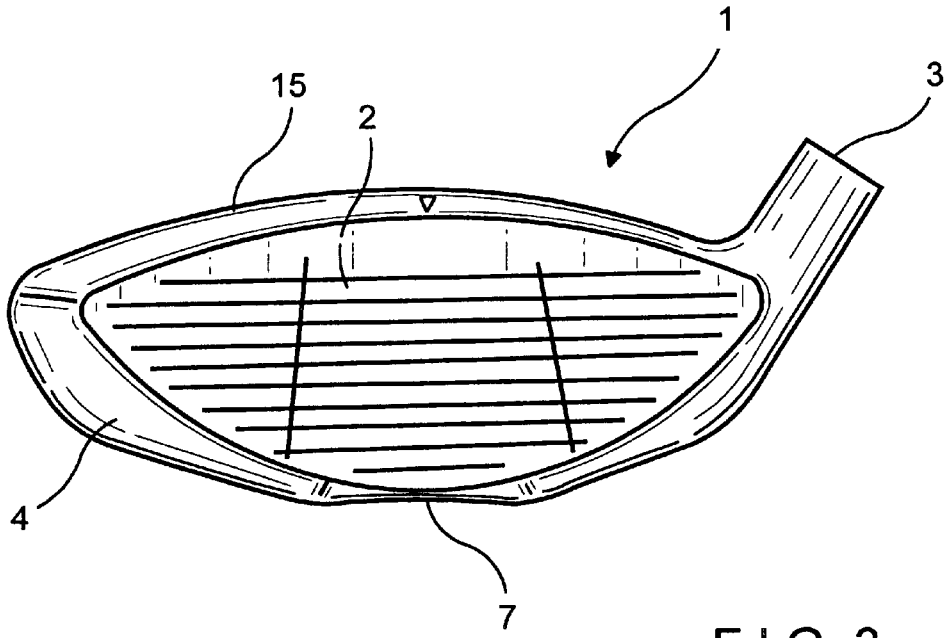
FIG. 3 shows the club head from the aforementioned figures seen from the front towards the striking surface.
Figure 4:
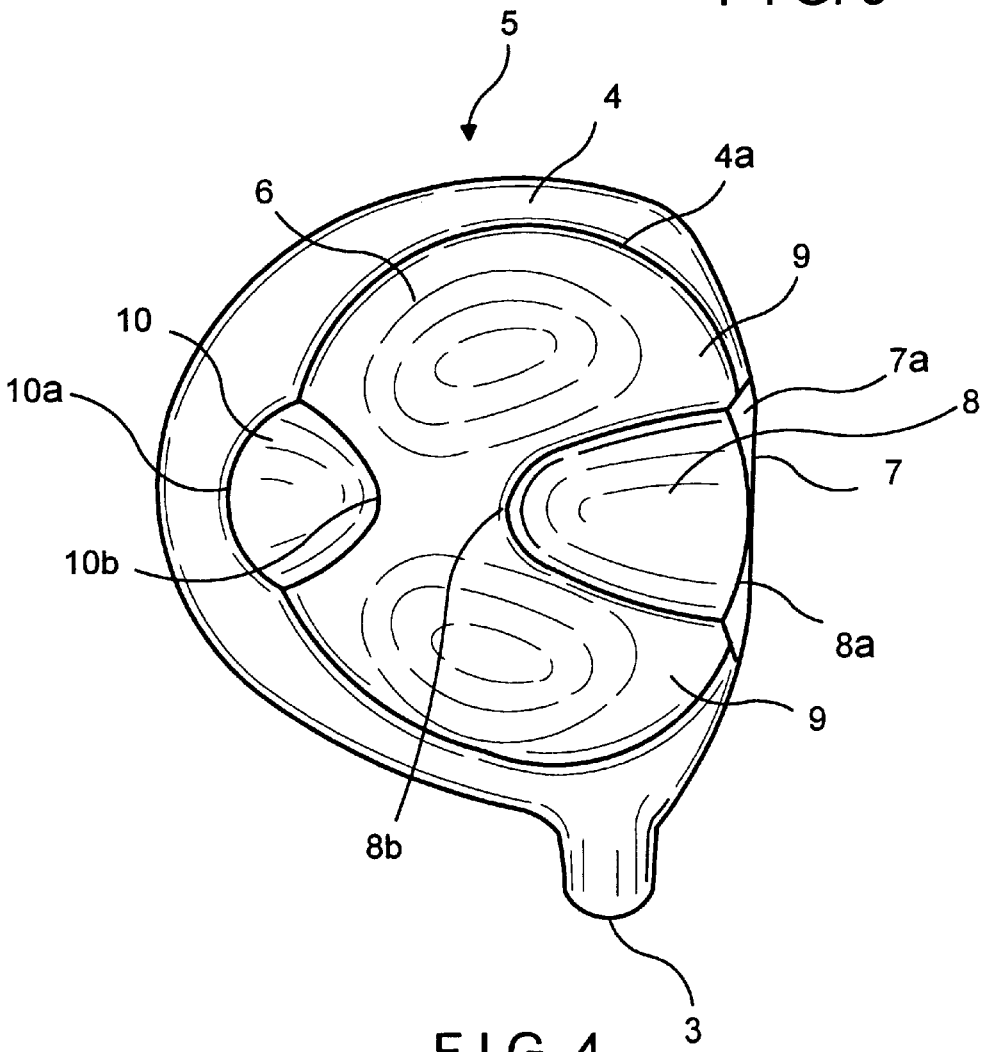
FIG. 4 shows the bottom surface of the golf club head with the different areas marked.
Figure 5:
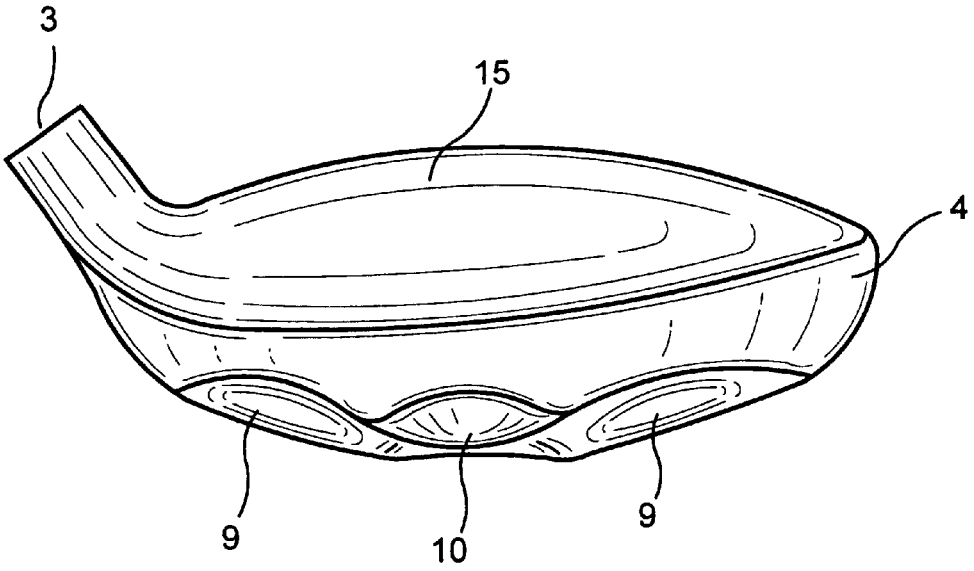
FIG. 5 shows the golf club head seen from behind and where the different areas are marked.
Figure 6:
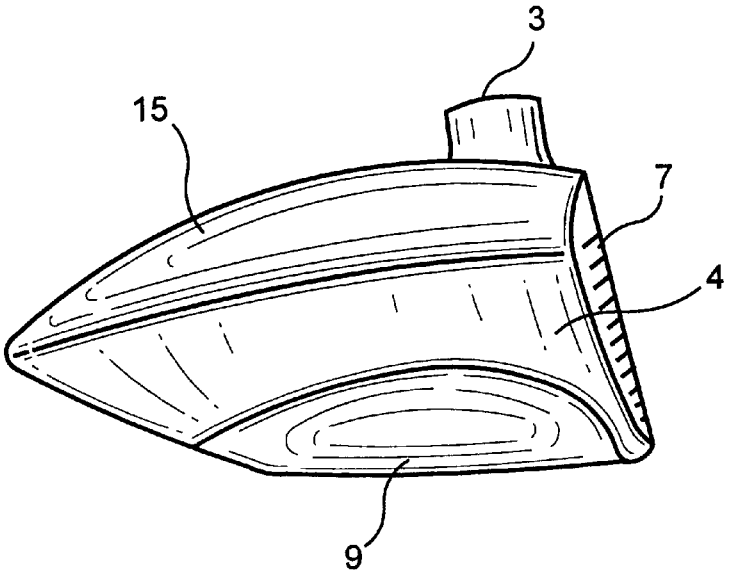
FIG. 6 shows the golf club head looking toward the bottom surface and the left side edge seen in relation to the striking surface.
Figure 7:
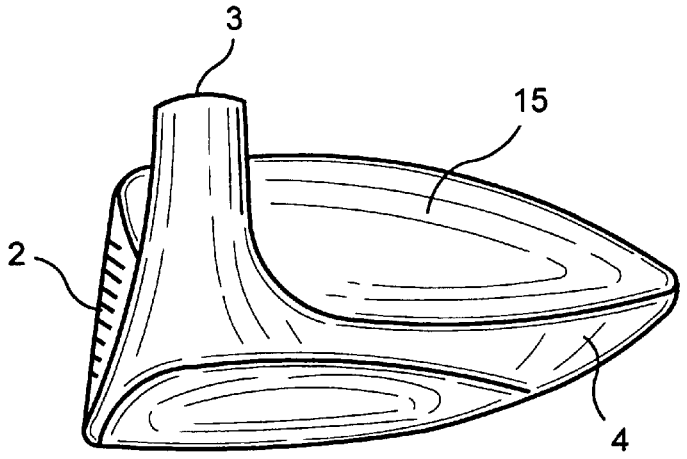
FIG. 7 shows the golf club head seen from the opposite side edge and with the striking surface pointing left.
Figure 8:
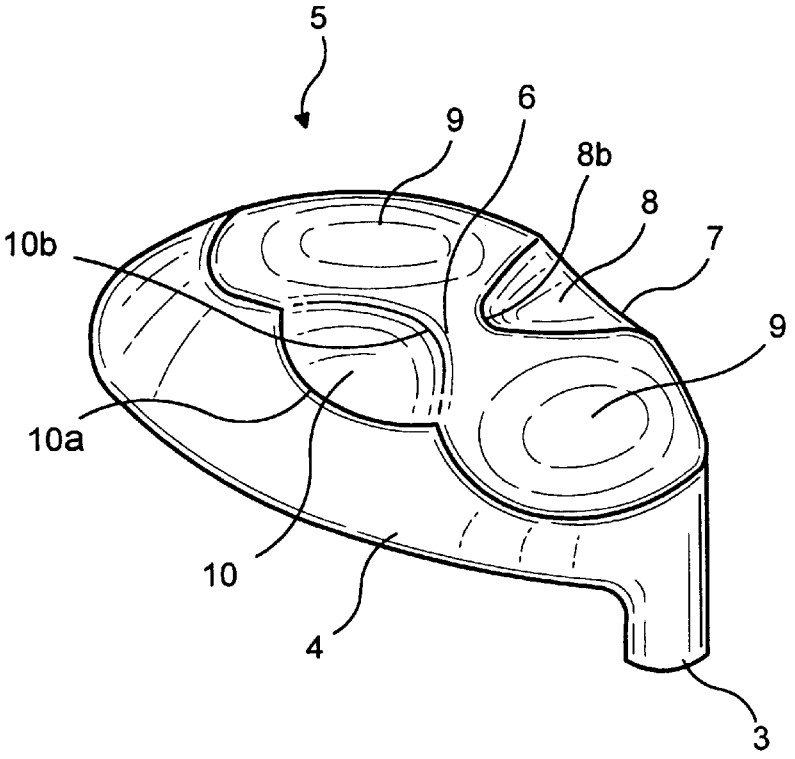
FIG. 8 shows the bottom and side surfaces of the gold club head, the different bottom areas being shaded.
Figure 9:
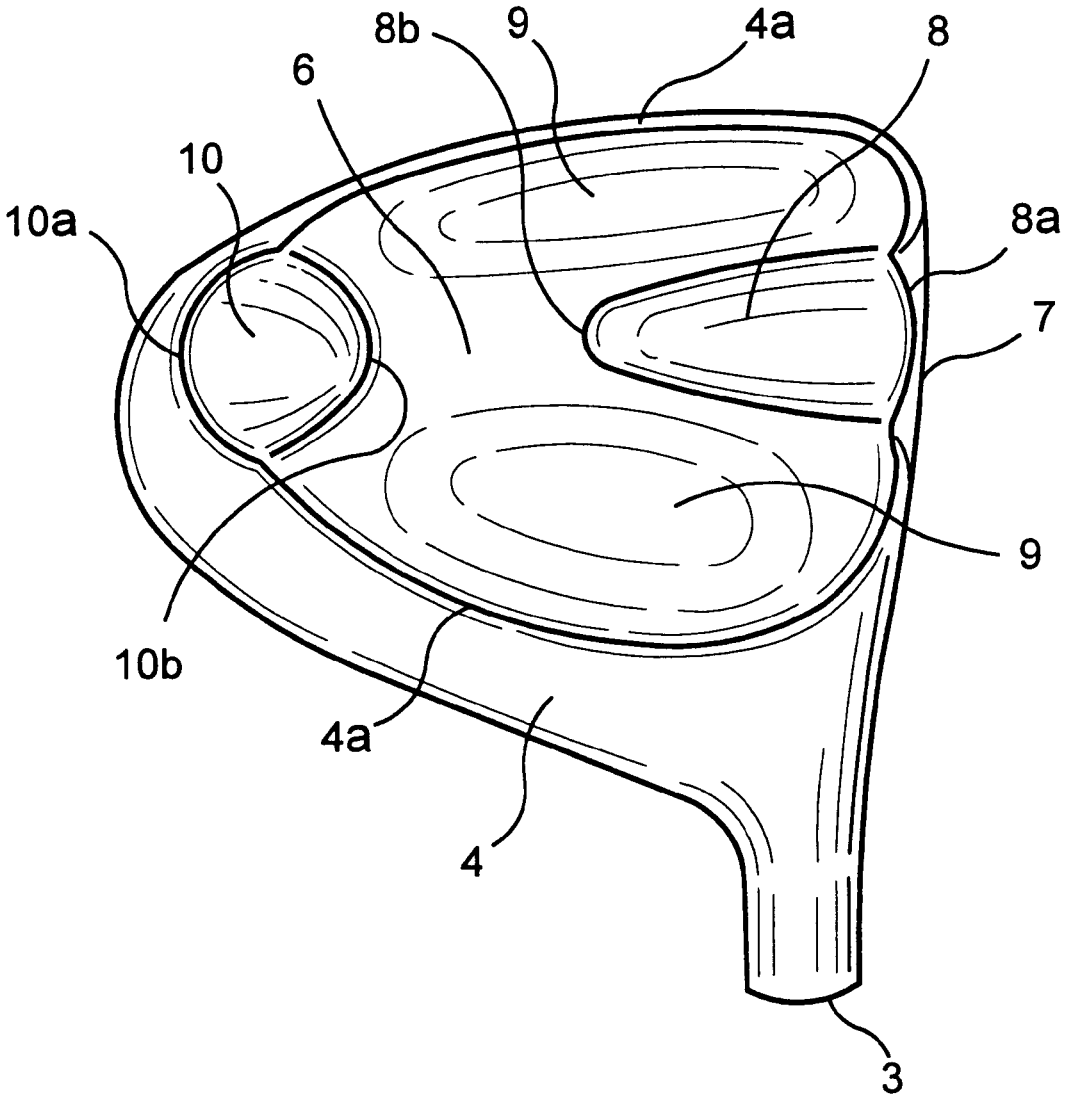
FIG. 9 shows a similar description of the bottom area as shown in FIG. 8, but from a different angle.
Figure 10:
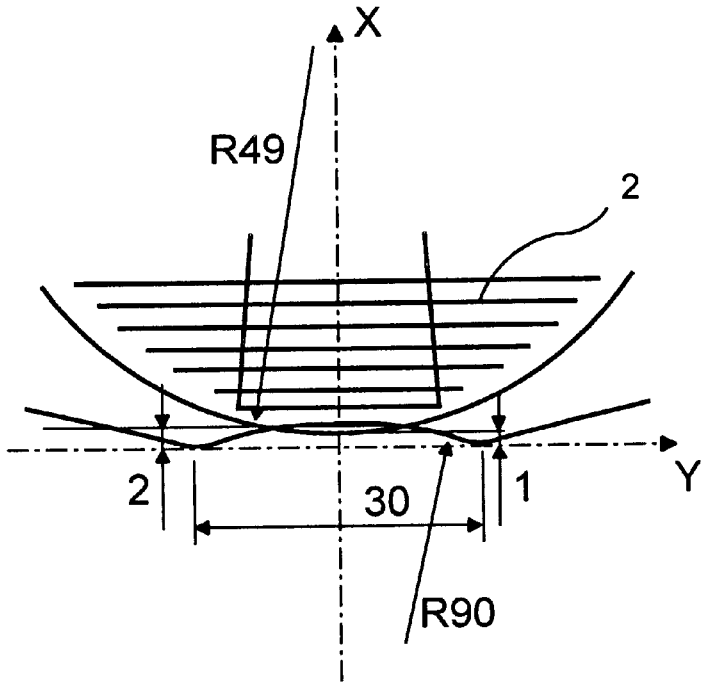
FIG. 10 shows an embodiment of the club head according to the present invention where a part of the club head is shown towards the striking surface and where important design parameters are included.
Figure 11:
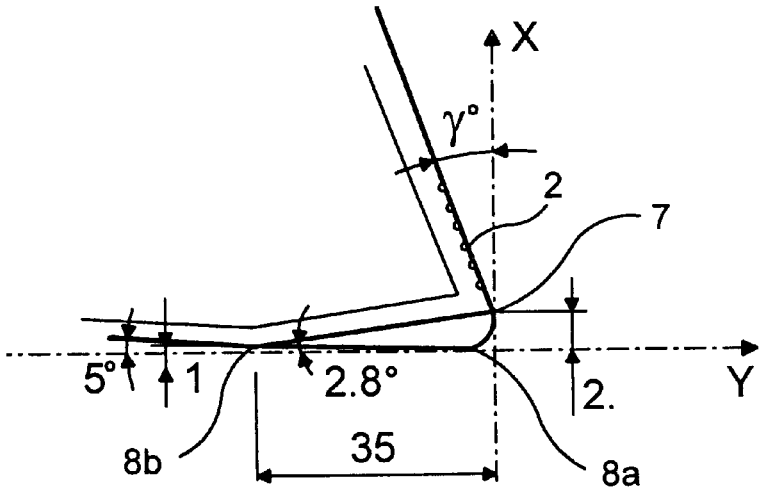
FIG. 11 shows the club head in FIG. 10 seen from the side with design parameters included.
Figure 12:
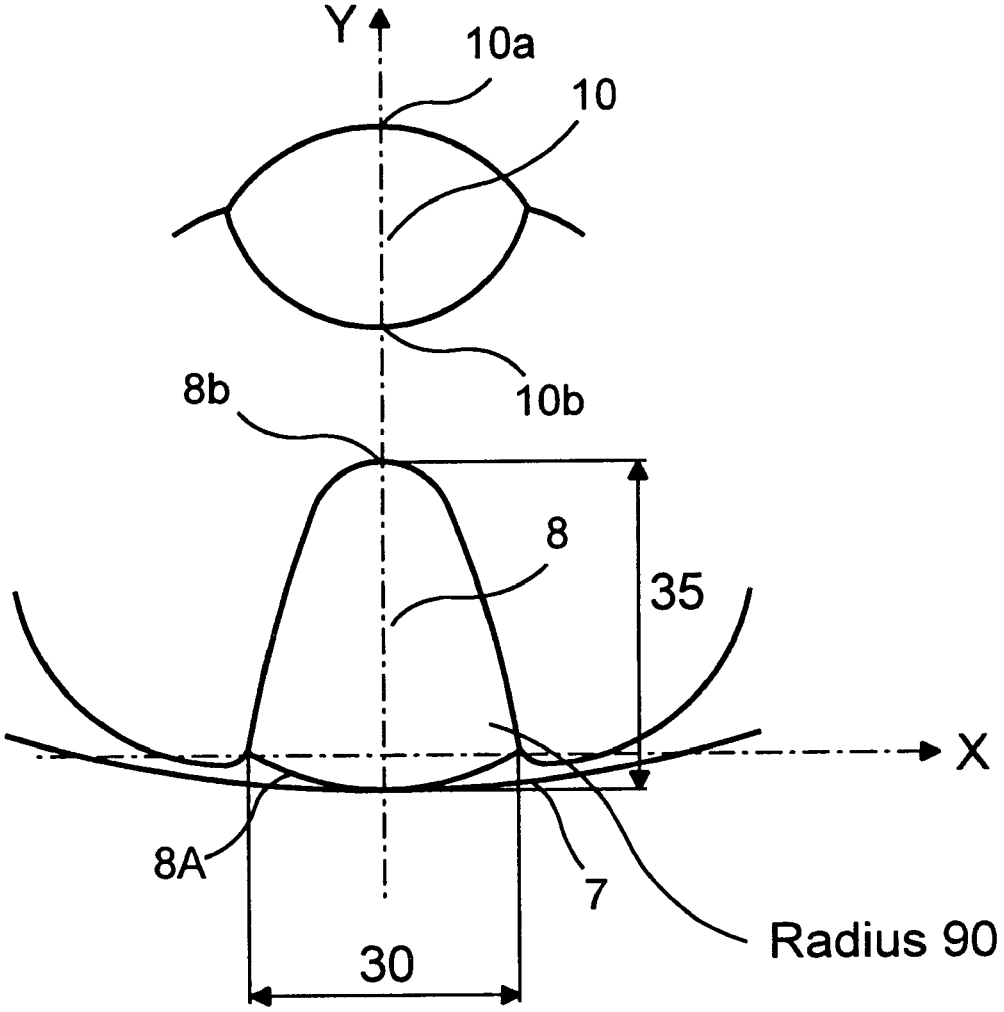
FIG. 12 shows important design parameters for the bottom area of the club head shown in FIGS. 10 and 11.
Figure 13:
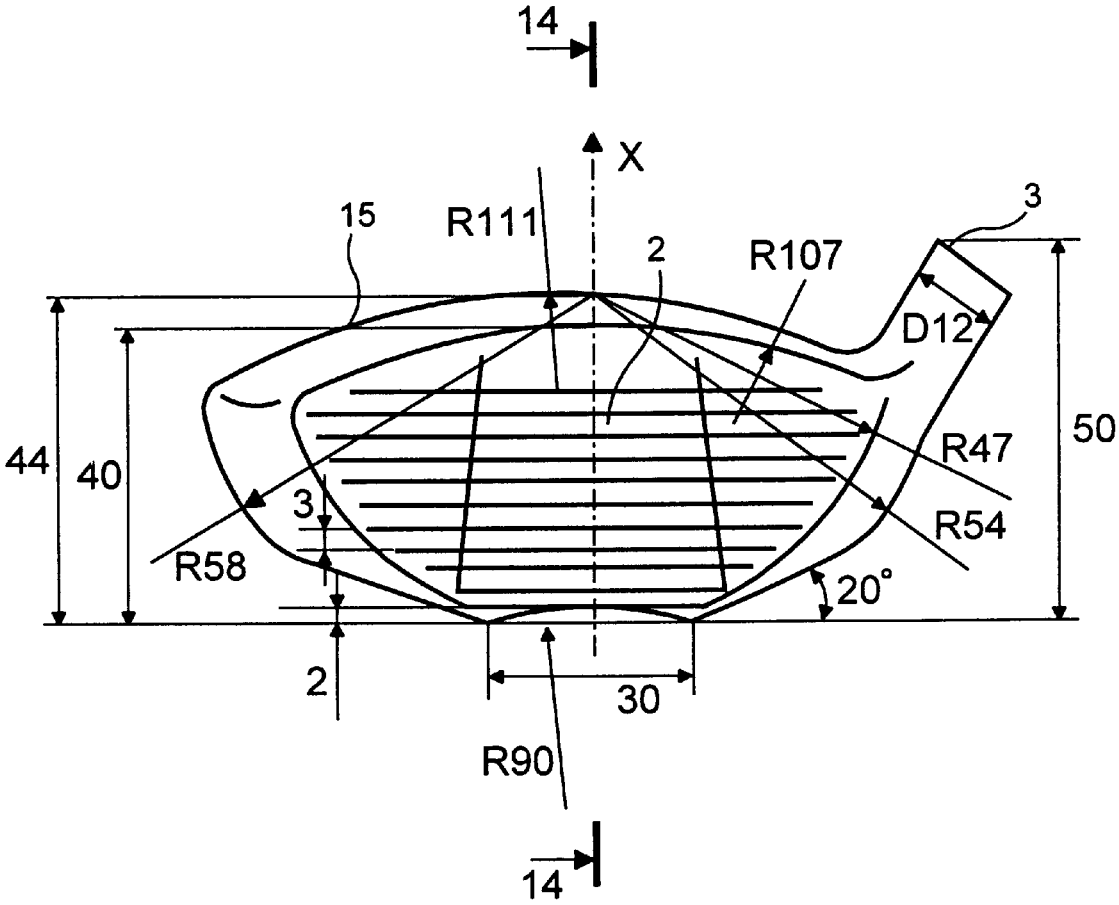
FIG. 13 shows the club head according to the present invention in a so-called driver embodiment and with design parameters included.
Figure 14:
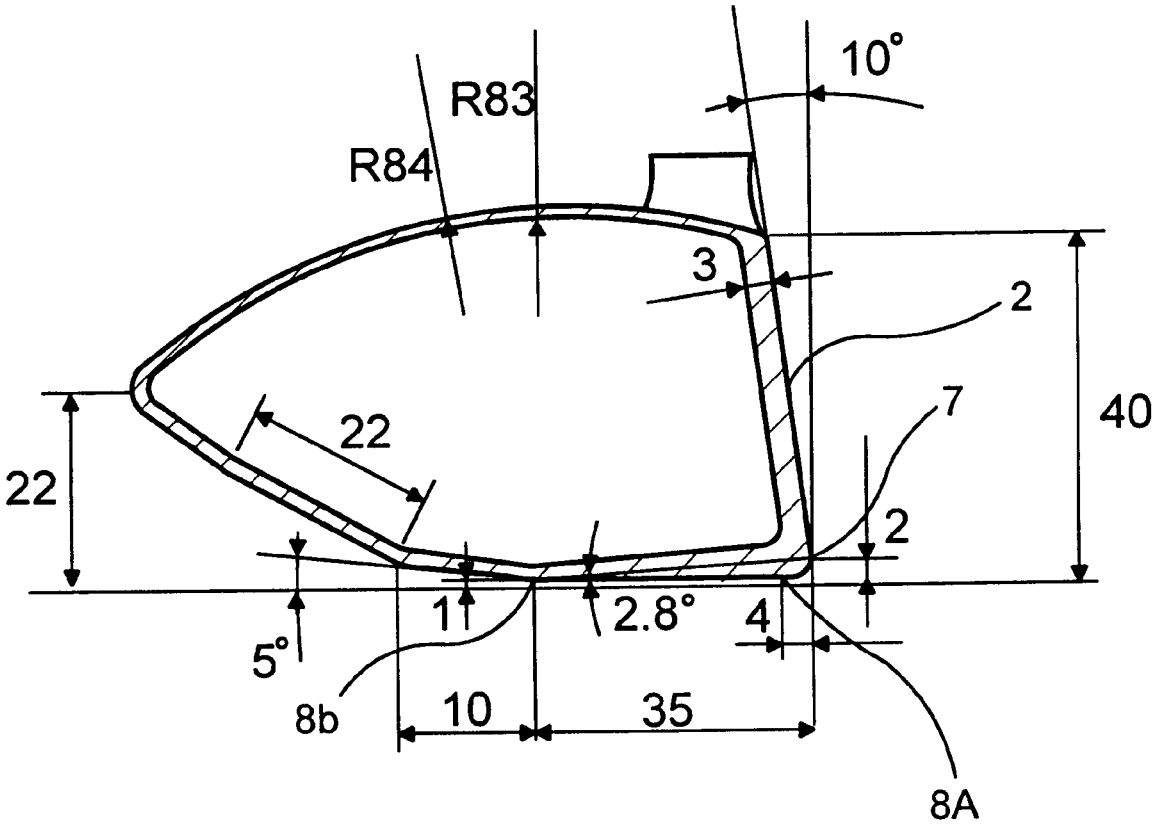
FIG. 14 shows the driver from FIG. 13 seen from the side and with design parameters included.
Figure 15:
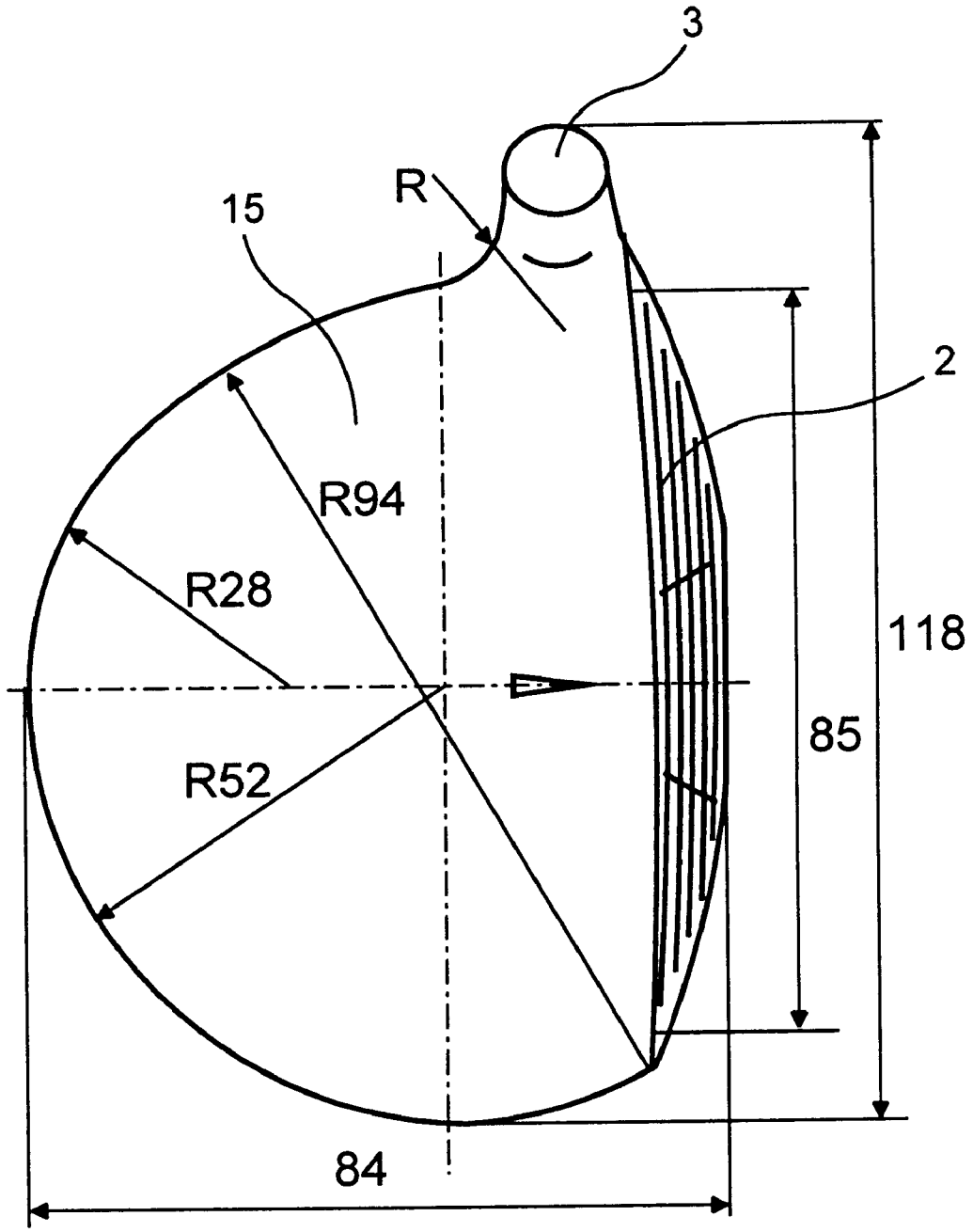
FIG. 15 shows the driver from FIGS. 13 and 14 seen from above and with design parameters included.
Figure 16:
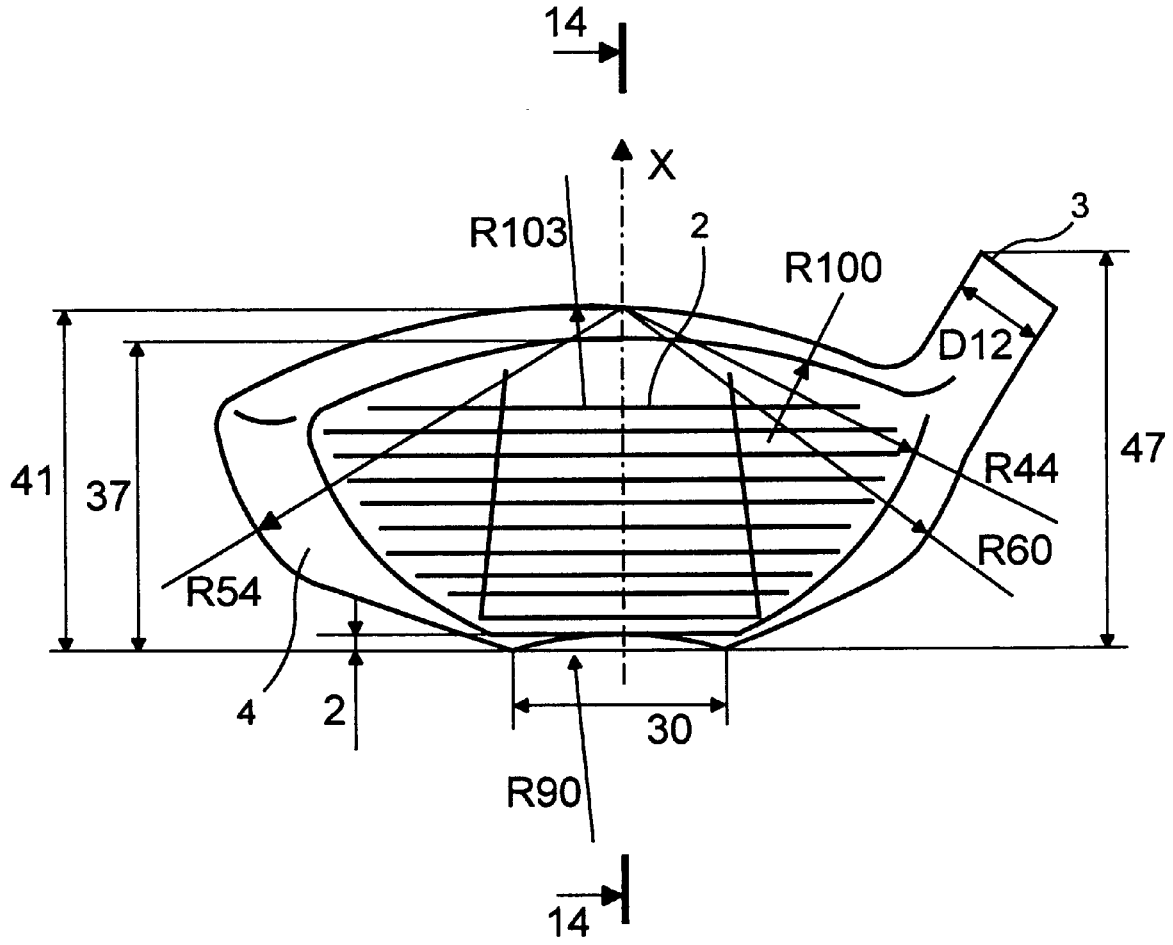
FIG. 16 shows the club head according to the present invention in a so-called fairway 3 embodiment seen from the front and with design parameters included.
Figure 17:
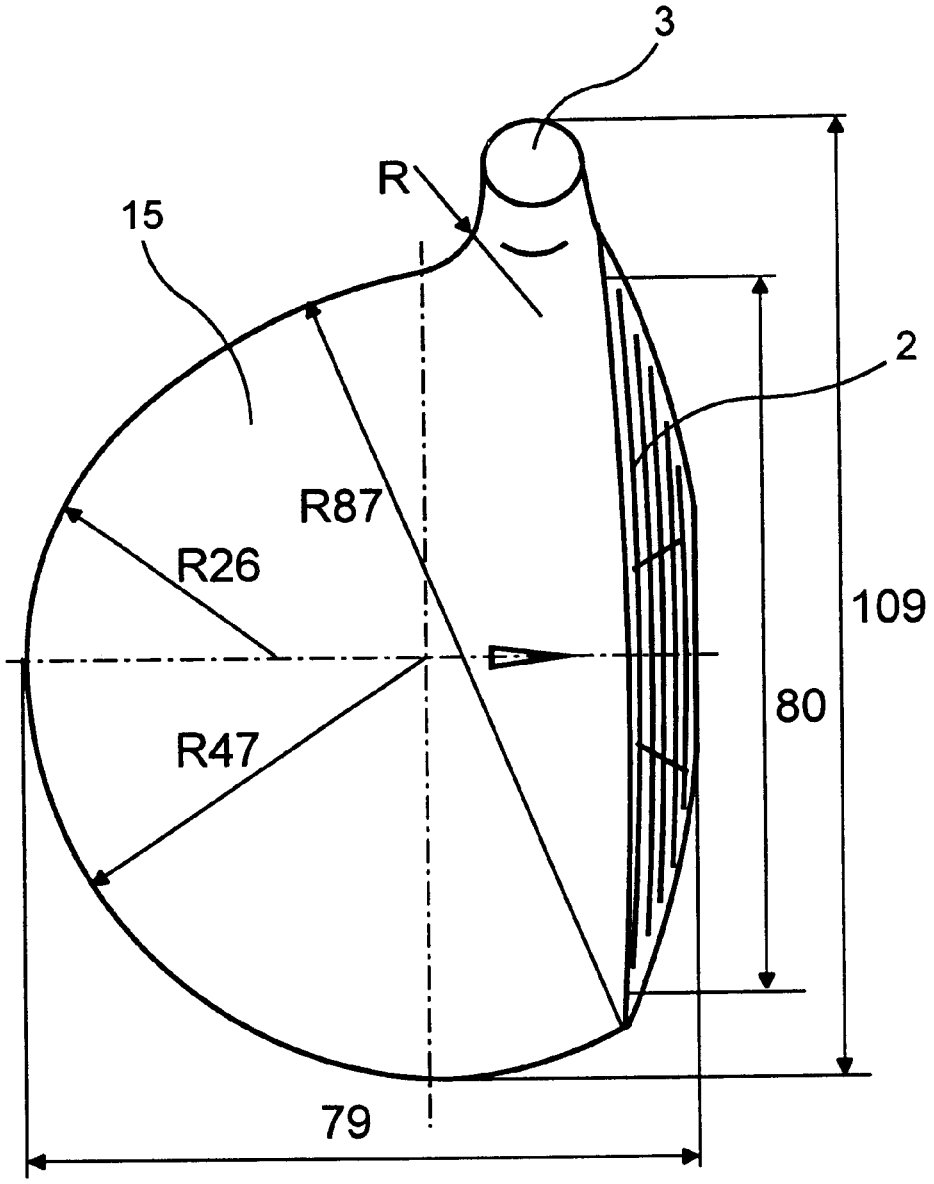
FIG. 17 shows fairway 3 from FIG. 16 seen from above and with design parameters included.

Referring first to FIG. 1 is a golf club head 1, seen from an angle above with the striking surface 2 pointing right. The golf club head 1 has mainly a "classic" design of the wood-type, and is shaped with a convex top surface 15 and side edges 4 and a striking (hitting) surface 2. The golf club head 1 is arranged with a shaft connection 3 on one of the sides in relation to the striking surface 2. The gold club head 1 is further arranged with an essentially convex bottom surface 5. The golf club head 1 according to the present invention differs from known techniques in respect to the shape of the bottom surface (sole) 5 itself. The shape of the bottom surface is explained with reference to FIGS. 3 to 9, inclusive. The bottom surface 5 is shaped with a central area 6 constituting the golf club head's lowest point, and that in the preferred embodiment of the invention will be 35 mm behind the club head's front edge 7. From the central area 6, the sole has a back part 10 that ends in a back edge 10*a* towards the golf club head's side 4. The back part 10 is almost level. From the central area 6 the bottom surface 5 has preferably level areas or under side areas 9 that slant evenly towards the side edges 4. In front of the central area 6 the bottom surface 5 has a curved lowered area 8 that stretches towards the bottom surface's front edge 7. The curved lowered area 8 increases evenly in depth and width towards the bottom surface's front edge 7. The concave or lowered area 8 in an embodiment of the invention, shown in FIG. 14, ends 4 mm behind the front edge 7. The intermediate area between the lowered area 8 and the front edge 7 has a chamber 7*a*. In an embodiment of the invention the lowered area 8 is shaped in a circular arc with a radius of 90 mm, and the area 8 extends 35 mm behind the front edge 7. From the club head's front edge 7 there is a semi-circular area into which the lowered area 8 starts. The depression or the lowered area 8 has such a shape that the central area is lifted 2 mm inwards into the club head body compared to a traditional golf club head where the club head's front surface represents the lowest point of the club body. Furthermore the lowered area 8 is shaped in such a way that the deepest area i.e. the centre of the coned area 35 mm in from the bottom surface's front edge 7, is lifted 1 mm inside the club head body. The shape of the golf club head's bottom area 5 will entail that the club head's lowest point during a strike will be 35 mm behind the front edge 7. The advantage with this is that the club head 1 during a "normal" strike will not dig into the ground during the strike (struck too low). The club head 1 will instead surf over the ground and the striking force will only be reduced slightly, which results in the ball moving nearly as far and as straight as in a "clean" strike. Everything has its limitations, and it will therefore be obvious that if the club head is hit directly into the ground, the club head according to the present invention will, of course, not counteract this.

Another advantage with the shape of the club head according to the present invention is that the curved lowered area 8 in the club head's bottom surface 5 will contribute to reduce the resistance which in turn reduces the likelihood of the club head digging itself down during too low strikes. A further advantage with the present club head's shape is that when the club head 1 hits the ground or more correctly the grass, the grass will be flattened instead of cut off. This, too, gives less resistance and friction and is very efficient on the fair way and out on the rough (longer grass). The golf club head 1 is also relatively high so that the hitting surface's area is preserved. This means that the club head 1 is easier to manage in long grass.

The present invention is explained by examples of embodiment, but it is obvious that the golf club head itself with the improved design shapes must be adapted to the clubs usage.

What is claimed is:

1. In a golf club head (1) of the wood type with a striking surface (2) on a front area, a shaft connection (3) on a side (4) in relation to the striking surface (2) and a bottom surface (4), the improvement wherein the bottom surface (5) from a central area (6) and to a front edge (7) of the bottom surface (5) towards the striking surface (2) has a curved lowered area (8) in relation to adjoining underside areas (9) of the bottom surface (5) on opposite sides of the bottom surface (5), the curved lowered area (8) having an evenly increasing depth towards the front edge (7).

2. The golf club head (1) as described in claim 1, wherein the lowered area (8) increases in width from the central area (6) towards the front edge (7).

3. The golf club head (1) as described in claim 1, wherein the curved area (8) has an even, curved concave arch and exhibits a depth at an end by front edge (7) in relation to adjoining side edges **(4*a*)** of about 2 to 3 mm.

4. The golf club head 1 as described in claim 1, wherein the lowered area (8) has a chamber **(7*a*) towards the end by the front edge (7)**.

5. The golf club head (1) according to claim 1, wherein the curved lowered area (8) extends about 35 mm along a bottom center axis (y—y) of the bottom surface (5) from the front edge (7) towards a back edge **(8*b*)**.

6. The golf club head (1) according to claim 5, wherein the curved lowered area (8) has a maximum width of approximately 30 mm along a transversely extending axis (x—x) that runs perpendicularly to the center axis (y—y) at a distance of 4 mm inside the front edge (7), the maximum width being symmetrically distributed on opposite sides of the center axis (y—y).

7. The golf club head (1) according to claim 1, wherein the curved lowered area (8) has a circular arc with a radius of approximately 90 mm.

8. The golf club head (1) according to claim 1, wherein the central area (6) constitutes a lowest point of the bottom surface (5) and is positioned approximately in the middle of the bottom surface (5).

* * * * *